United States Patent [19]

Tunberg

[11] Patent Number: 4,548,349

[45] Date of Patent: Oct. 22, 1985

[54] PROTECTIVE SLEEVE FOR A PAPER CUP

[75] Inventor: Robert A. Tunberg, Moline, Ill.

[73] Assignee: Whitey's Ice Cream Manufacturers, Inc., Moline, Ill.

[21] Appl. No.: 596,286

[22] Filed: Apr. 3, 1984

[51] Int. Cl.[4] ..... A47G 19/22; A47J 45/10

[52] U.S. Cl. ..... 229/1.5 H; 220/85 H

[58] Field of Search ..... 220/85 H; 229/1.5 H, 229/1.5 B

[56] References Cited

U.S. PATENT DOCUMENTS 2,028,566 1/1936 Seipel ..... 229/1.5 H 3,456,860 7/1969 Janninck ..... 229/1.5 B

FOREIGN PATENT DOCUMENTS 558159 1/1975 Switzerland ..... 229/1.5 H 1434023 4/1976 United Kingdom ..... 220/85 H

*Primary Examiner*—George E. Lowrance

*Attorney, Agent, or Firm*—Neuman, Williams, Anderson & Olson

[57] ABSTRACT

The invention consists of a protective sleeve that fits around and protects a paper cup used in the preparation of various confectionary drinks such as malted milk and ice cream shakes. The sleeve is a hollow, tapered cylinder having a substantially smooth inner surface that contacts the paper cup over a portion of the cup's surface area and provides structural support for the cup area contacted and rigidity to the cup area not contacted. This cylinder has an outer surface with a roughened portion which enables an operator to securely grip it.

3 Claims, 3 Drawing Figures

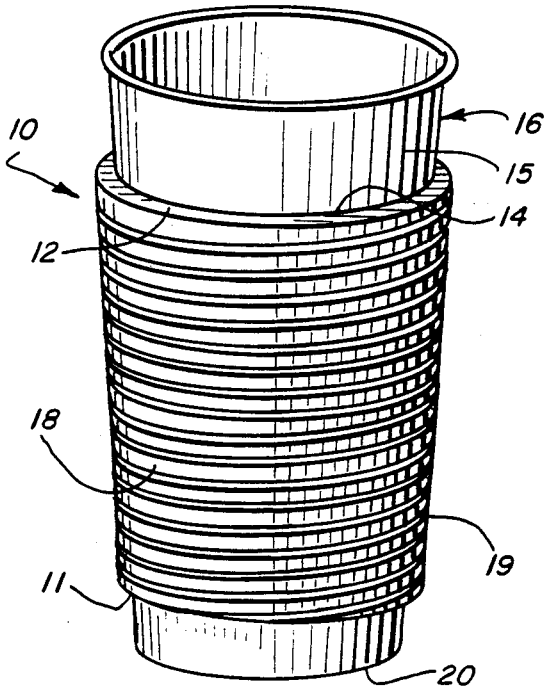
FIG. 1
FIG. 3
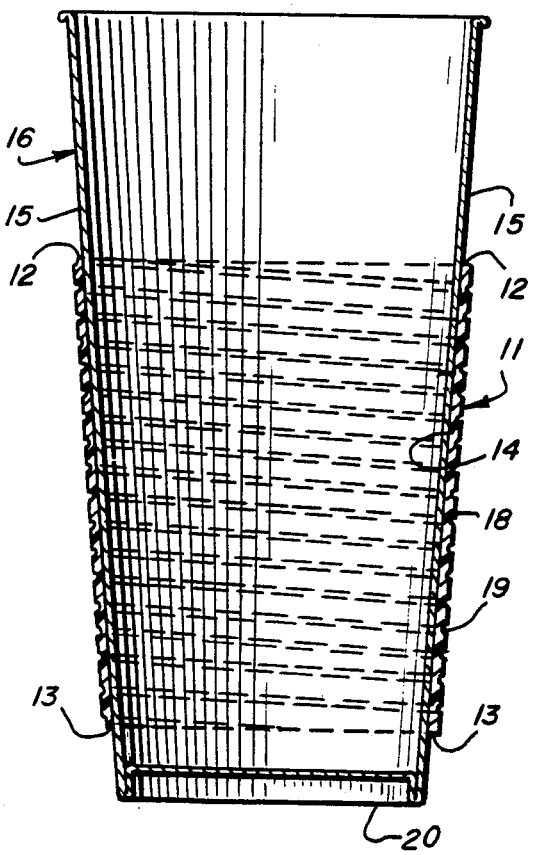
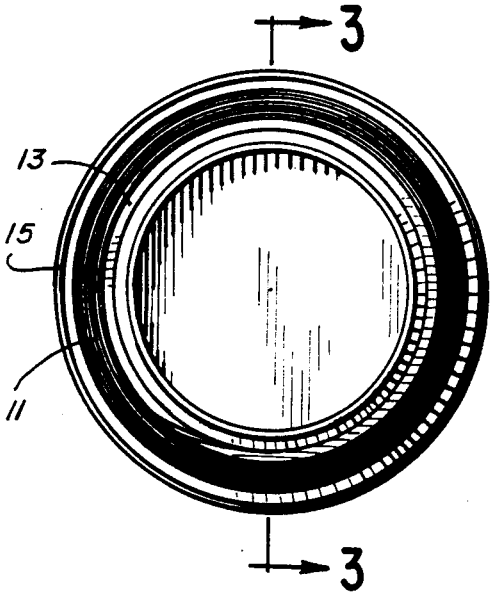
FIG. 2

PROTECTIVE SLEEVE FOR A PAPER CUP

BACKGROUND OF THE INVENTION

1. Field of the Invention

The present invention relates to a protective sleeve, and more particularly to a protective sleeve that fits around and protects a paper cup used in the preparation of various confectionary drinks such as malted milk and ice cream shakes.

2. Description of the Prior Art

Restaurants and ice cream shops prepare confectionary-type drinks such as malted milk and ice cream shakes for their customers using an electric mixer to properly blend the various ingredients. A typical electric mixer used to make these products consists of a base, an upright support, a power head, and a vertical shaft extending downward from the power head with a propellertype metallic mixing element attached to its free end. An electric motor in the power head drives the shaft which spins the mixing element. The container commonly used to hold the ingredients during the mixing operation is a metal, typically stainless steel, receptacle. The metal receptacle can withstand the impact of the metallic mixing element which occurs during the numerous instances when the operator inadvertently allows the metal receptacle to come into contact with the spinning mixing element.

Using a metal receptacle or container to prepare malted milk and ice cream shakes has proven costly, cumbersome, noisy, and time consuming. The metal containers are heavy stainless steel receptacles which become quite cold and facilitate the condensation of moisture on the exterior of the container during the mixing operation. These cold, moist, and smooth stainless steel containers tend to slip out of workers hands, especially if the workers hands are wet. During mixing, the mixing element often strikes the metal container making loud grinding sounds which are unpleasant and disconcerning to the waiting purchaser. In addition, after mixing, the worker must transfer the malted milk or ice cream shake into a glass or a paper cup which the worker actually gives to the customer for use. Before mixing another shake or malt, the worker must thoroughly wash the metal container. This additional washing step is time consuming and costly. In addition, in transferring the malt or shake from the metal container to the paper or glass, the potential for spilling the product presents itself. These spills are also costly and time consuming.

To overcome the disadvantages in using metal containers many restaurants and ice cream shops now use paper cups to both mix and serve the malted milk or ice cream shake to their customers. The establishments that use the single paper cup to prepare and serve these drinks have encountered a number of problems. The metallic mixing element of the mixer punctures or rips the sides of the paper cup every time the two come into contact. The puncturing or ripping of the paper cup generally results in the spilling of the contents which requires clean up and lost time. Furthermore, the loss of ingredients frequently requires the worker to start the entire mixing process over with new ingredients since the customer expects to receive a properly mixed product with the proper proportions of ingredients. The remixing of the product with fresh ingredients commonly results in an outright loss of the discarded ingredients to the establishment. Even if spillage does not occur, the transfer to another cup to complete the mixing operation is costly to the establishment and reduces the profit for the product. In addition to these purely economic concerns, the ripping or puncturing of the cup by the metal mixing element can seriously injure the operator by lacerating the fingers that hold the cup. Furthermore, since the mixing operation requires the operator to frequently turn the paper cup by hand, the pressure exerted on the cup by the operator tends to deform the cup and bend the surrounding lip. When the lip portion of the cup bends, portions of the cup's protective wax come loose and present an unsightly appearance to the customer. In addition, the loosened wax can actually get into the consumers mouth during drinking which, while not harmful, distracts from the overall product appeal.

In todays marketplace the use of pieces of hard candy such as M&M, Reeses Pieces and the like as additives to the traditional milk shake have become quite popular. When making malts and shakes with bits of hard candy as one of the ingredients an additional problem arises. When the mixing element strikes the hard candy, it breaks the candy into pieces and propells these pieces against the sides of the cup at a high speed. Some of the candy pieces puncture the sides of the cup. This, of course, has all of the disadvantages referred to above.

The protective sleeve of the present invention avoids the problems discussed above. The sleeve is a simple and inexpensive device. It allows restaurants and ice cream shops to prepare malted milk and ice cream shakes in the paper cups that they use to serve their customers; it prevents puncturing of the cup's sidewalls by the mixing element or the hard objects in the ingredients; and it prevents buckling of the cup during mixing.

OBJECTS OF THE INVENTION

It is a general object of this invention to provide a protective sleeve for paper cups.

It is an object of the present invention to provide a simple, inexpensive, and reusable protective sleeve for paper cups used in making malted milk, ice cream shakes and similar confectionary drinks.

It is another object of this invention to provide a protective sleeve for paper cups of all sizes that prevents the puncturing of the cups by the mixing apparatus, or by the ingredients being mixed, thus, preventing spillage and injury to workers.

It is yet another object of this invention to provide a protective sleeve for paper cups that functions as a handle and prevents the buckling of the rim and sidewalls of the cup during the mixing of the malted milk, ice cream shakes and similar confectionary drinks.

Other objects, advantages, and features of the present invention will become apparent upon reading the following detailed description and appended claims and upon reference to the accompanying drawings.

SUMMARY OF THE INVENTION

In accordance with the preferred embodiment of the invention, the applicant provides a sleeve for receiving a portion of a paper cup used in preparing malted milk, ice cream shakes and similar confectionary drinks. This sleeve prevents the mixing device or the ingredients being mixed from ripping or puncturing the cup; it provides structural integrity to the paper cup to avoid deformation during the mixing operation; and it protects the operator from injury by preventing the mixer from ripping through the paper cup and lacerating the operator's fingers. The protective sleeve is a slightly tapered hollow cylinder made of plastic or other suitable material. The cylinder has a substantially smooth inner surface which engages and abuts against a substantial portion of the outside surface of the paper cup's sidewalls. The smooth inner surface of the sleeve reinforces the cup and prevents the puncturing of the cup over the area of contact between the sleeve and cup. The sleeve, contacting the cup over a substantial portion of the cup's surface area, stiffens the unsupported surface area of the cup and prevents the cracking or buckling caused by the crushing force of a workers hand during the mixing operation. The sleeve provides support against buckling along the cup's entire linear extension, including the lip of the cup. The outer surface of the sleeve includes a roughened portion with any one of many possible configurations such as spiral grooves, allowing the operator who holds the sleeve to firmly grip it during mixing, preventing the sleeve and the cup from slipping out of the operator's hands and allowing the operator to grip the sleeve when separating the sleeve from the cup after the mixing is completed.

In assembling the sleeve and paper cup into an integral, rigid unit and in using the assembly, the operator or worker first inserts the paper cup into the sleeve and allows it to drop until the entire smooth inner surface of the sleeve abuts against the smooth, tapered outer surface of the cup. Using the sleeve as a handle, the operator then places all of the ingredients for a malted milk or ice cream shake in the cup. The weight of the ingredients pushes the cup farther down in the sleeve and press fits the cup and sleeve together. The operator mixes the ingredients and then places the cup upright on a flat horizontal surface. By holding the sleeve and pulling down on it, the operator can disengage the sleeve from the cup and remove it.

BRIEF DESCRIPTION OF THE DRAWING

For a more complete understanding of this invention, one should now refer to the embodiment illustrated in greater detail in the accompanying drawing and described below by way of an example of the invention. In the drawing:

FIG. 1 is a perspective view of the preferred embodiment of the protective sleeve in place around a paper cup.

FIG. 2 is a bottom view of the protective sleeve in place around a paper cup.

FIG. 3 is a sectional view taken along line 3—3 of FIG. 2.

While the applicant will describe the invention in connection with a preferred embodiment, one will understand that the invention is not limited to this embodiment. Furthermore, one should understand that the drawing is not necessarily to scale. In certain instances, the applicant may have omitted details which are not necessary for an understanding of the present invention or those which are difficult to perceive.

DETAILED DESCRIPTION OF THE DRAWING AND PREFERRED EMBODIMENT

Turning now to the drawing, FIG. 1 shows the preferred embodiment of a protective sleeve around a paper cup according to the invention generally at 10. The protective sleeve 11 is a slightly tapered hollow cylinder made of plastic or any other suitable material. The two ends of the cylindrical sleeve 11 form an upper ring shaped surface 12 (shown in FIG. 1) and a lower ring shaped surface 13 (shown in FIG. 2). The upper ring surface 12 is substantially parallel to the lower ring surface 13; and the upper ring surface's average diameter is greater than that of the lower ring surface 13.

The inner surface 14 (shown in FIG. 3) is a substantially smooth surface tapered so that the entire surface will engage and abut against a substantial portion of the smooth tapered surface 15 of the paper cup 16. By use of the phrase substantially smooth applicant intends to include a surface with slight irregularities that do not substantially reduce the area of contact between the sleeve and the paper cup but may help remove any condensation between the sleeve and the cup. In this abutting position, the sleeve 11 reinforces the cup to resist puncturing and supports it against the crushing force of the workers hand during mixing.

The outer surface 18 of the protective sleeve 11 has a roughened portion. In the preferred embodiment, this roughened portion is a spiral groove 19 cut around the sleeve and covering the entire outer surface 18. The groove 19 provides resistance to sliding when an operator or worker holds the cup 15 and its contents, and it allows the operator to remove the sleeve 11 from the paper cup after mixing. Although the preferred embodiment shows a spiral groove, any one of a number of roughened surface configurations can function as effectively as the spiral groove and it is not necessary that the roughed portion extend over the entire outer surface 18. For example, other groove configurations may include vertical, horizontal or inclined grooves or combinations that form various patterns.

In assembling the sleeve and paper cup into an integral, rigid unit and in using the assembly, the operator or worker first inserts the paper cup 16 into the sleeve 11 and allows it to drop until the entire smooth, tapered inner surface 14 of the sleeve 11 abuts against the smooth, tapered outer surface 15 of the paper cup. When the paper cup 16 has come to rest in this position, its bottom edge 20 has moved passed the ring shaped surface 13 of the sleeve 11. The sleeve 11 covers a substantial linear extension of the cup 16 or much of the cup's outer surface 15; however, the sleeve does not cover a portion of the top and bottom of the outer surface 15. One can appreciate that the sleeve 11 fits around a number of sizes of cups. When using the sleeve 11 with large cups, the sleeve would come to rest lower on the cup's outer surface 15 than it would on a small cup.

Using the sleeve 11 as a handle, the operator places all of the ingredients for a malted milk, ice cream shake or similar confectionary drinks in the paper cup 16. The weight of the ingredients pushes the cup father down in the sleeve 11 and press fits the paper cup 16 and the sleeve 11 together.

The operator then mixes the ingredients. Some of the ingredients may be pieces of hard candy, and the mixing element that the operator inserts into the cup to mix the ingredients may propell the candy against the sides of the cup at high velocities. This candy will not puncture the sides of the paper cup 16 because the sleeve 11 reinforces the cup against puncturing. In addition, even if the metallic mixing element contacts the paper cup during mixing, the reinforcement or support from the sleeve will prevent the ripping of the cup and the spilling of the ingredients. Furthermore, the sleeve safely separates the operators hand from the metallic mixing element, thus eliminating any possible harm to the operators hand.

After mixing, the operator places the paper cup and sleeve assembly upright on a flat horizontal surface. By holding the sleeve 11 around its outer surface 18 and pulling down, the operator can disengage the sleeve from the cup and remove it.

Thus, the applicant has provided a protective sleeve for paper cups used in making malted milk, ice cream shakes and similar confectionary drinks. The sleeve protects the paper cup and the worker using the sleeve. The sleeve is simple, inexpensive, and reusable. It functions as a handle and fits cups of all sizes. It prevents the puncturing of the paper cups by the mixing apparatus and thus, prevents spillage and injury to the worker. It also prevents the buckling of the rim and sides of the paper cup during the mixing of the malted milk, ice cream shakes and similar confectionary drinks.

While the applicant has shown only one embodiment of the invention, one will understand, of course, that the invention is not limited to this embodiment since those skilled in the art to which the invention pertains may make modifications and other embodiments of the principles of this invention particularly upon considering the foregoing teachings. The present invention discloses a sleeve of plastic or similar material adapted to receive a paper cup and to conform to a substantial portion of the outside surface area of the cup, providing structural support for the portion of the cup in contact with the sleeve and providing strengthened rigidity to the portion of the cup not in contact with the sleeve. The exterior portion of the sleeve must have means such as a roughened surface area to facilitate the operator disengaging the sleeve from the cup when the mixing operation is complete. The applicant, therefore, by the appended claims, intends to cover any such modifications and other embodiments as incorporate those features which constitute the essential features of this invention.

What is claimed is:

1. A protective sleeve for use with a paper cup and a mixing apparatus by an operator in preparing confectionary drinks and for protecting the paper cup against puncturing and the operator against injury from the mixing apparatus, said sleeve comprising a hollow cylinder for receiving and holding the paper cup, said cylinder being tapered and providing a press fit with said cup when the ingredients of the confectionary drinks are placed in said cup, said cylinder having a length sufficient to surround a substantial linear extension of the cup when the cup is inserted into said sleeve, said cylinder also having opposite annular end portions, a substantially smooth, tapered inner surface adapted to engage and abut against the outer surface of said cup over a substantial linear extension of said cup and to provide structural support and puncture resistance for the cup area contacted by said smooth inner surface and rigidity to the cup area not contacted by said smooth inner surface, and an outer surface with a groove means cut into said outer surface and covering essentially said out surface forming a roughened portion for enabling the operator to securely grip said sleeve.

2. A protective sleeve as in claim 1, wherein said (groove of said cylinder) comprises a spiral groove.

3. A protective sleeve as in claim 1, wherein said opposite end portions of said cylinder are substantially parallel.

* * * * *